US011014323B2

(12) United States Patent
Daering et al.

(10) Patent No.: US 11,014,323 B2
(45) Date of Patent: May 25, 2021

(54) STAND UP POUCH WITH FITMENT

(71) Applicant: HFM PPC Flexible Packaging, LLC, Pewaukee, WI (US)

(72) Inventors: Andy Daering, Waukesha, WI (US); Geoff Erickson, Brookfield, WI (US); Jon M. Riggs, Oconomowoc, WI (US); Mark Mawer, Cedarburg, WI (US)

( * ) Notice: Subject to any disclaimer, the term of this patent is extended or adjusted under 35 U.S.C. 154(b) by 0 days.

(21) Appl. No.: 16/585,254

(22) Filed: Sep. 27, 2019

(65) Prior Publication Data

US 2020/0115129 A1 Apr. 16, 2020

Related U.S. Application Data

(60) Provisional application No. 62/743,858, filed on Oct. 10, 2018.

(51) Int. Cl.

| | |
|---|---|
| ***B31B 70/84*** | (2017.01) |
| ***B65D 75/58*** | (2006.01) |
| ***B65D 75/00*** | (2006.01) |
| ***B31B 70/60*** | (2017.01) |
| ***B31B 70/64*** | (2017.01) |
| ***B31B 70/26*** | (2017.01) |
| *B31B 160/10* | (2017.01) |
| *B31B 155/00* | (2017.01) |

(52) U.S. Cl.

CPC ..... *B31B 70/844* (2017.08); *B31B 70/26* (2017.08); *B31B 70/61* (2017.08); *B31B 70/64* (2017.08); *B65D 75/008* (2013.01); *B65D 75/5883* (2013.01); *B31B 2155/00* (2017.08); *B31B 2160/102* (2017.08)

(58) Field of Classification Search

CPC ..... B31B 70/64; B31B 70/844; B31B 70/26; B31B 70/61; B31B 2155/00; B31B 2160/102; B31B 70/14; B31B 70/813; B31B 70/8132; B31B 70/8133

USPC ..... 493/210, 209, 213, 214, 223, 225

See application file for complete search history.

(56) References Cited

U.S. PATENT DOCUMENTS

| | | | | |
|---|---|---|---|---|
| 4,732,299 A * | 3/1988 | Hoyt | B29C 65/02 | 222/107 |
| 5,290,105 A * | 3/1994 | Tencati | B65D 75/5883 | 215/12.2 |
| 5,606,844 A * | 3/1997 | Takagaki | B29C 65/08 | 53/410 |
| 5,855,544 A * | 1/1999 | Buchanan | B29C 66/65 | 493/102 |
| 5,911,340 A | 6/1999 | Uematsu | | |

(Continued)

*Primary Examiner* — Sameh Tawfik

(74) *Attorney, Agent, or Firm* — Andrus Intellectual Property Law, LLP

(57) ABSTRACT

A flexible pouch for receiving flowable products that includes a fitment having a spout to allow the flowable products to be discharged from the pouch. The flexible pouch is formed from a top and a bottom web of material. A sealant strip is attached to a top edge of each of the top and bottom webs of material. A fitment having a canoe and spout is positioned such that the canoe is positioned between the first and second sealant strips. The height of the canoe and the width of the first and second sealing strips are the same to minimize the amount of sealant material. The first and second sealant strips are sealed to each other along the entire width of the flexible pouch to entrap the canoe of the fitment between the top and bottom webs.

12 Claims, 8 Drawing Sheets

(56) References Cited

U.S. PATENT DOCUMENTS

| | | | | |
|---|---|---|---|---|
| 6,273,307 | B1 * | 8/2001 | Gross | B65D 75/5883 220/613 |
| 6,419,118 | B1 | 7/2002 | Rees et al. | |
| 6,439,429 | B1 * | 8/2002 | Gross | B65D 41/34 222/92 |
| 6,662,530 | B1 * | 12/2003 | Millon | B65B 29/10 222/94 |
| 6,860,406 | B2 | 3/2005 | Kobetsky et al. | |
| 6,991,140 | B2 | 1/2006 | Bourque et al. | |
| 7,465,265 | B2 * | 12/2008 | Hinesley | 493/231 |
| 8,745,836 | B2 * | 6/2014 | Murray | B31B 70/00 29/428 |
| 8,834,024 | B2 | 9/2014 | Umenaka | |
| 9,598,215 | B2 | 3/2017 | Araki et al. | |
| 9,938,050 | B2 | 4/2018 | Berge | |
| 10,071,837 | B2 * | 9/2018 | Franca | C08F 293/00 |
| 10,668,670 | B2 * | 6/2020 | Franca | B29C 66/004 |
| 2005/0139607 | A1 | 6/2005 | Kobetsky et al. | |
| 2007/0047851 | A1 | 3/2007 | Sato et al. | |
| 2009/0255626 | A1 | 10/2009 | Murray | |
| 2013/0202228 | A1 | 8/2013 | Murray | |
| 2014/0263474 | A1 * | 9/2014 | Skillin | B65D 75/5883 222/541.9 |

* cited by examiner

STAND UP POUCH WITH FITMENT

BACKGROUND

The present disclosure generally relates to a flexible pouch for flowable products. More specifically, the present disclosure relates to a flexible, stand up pouch with a fitment and a method of inserting the fitment into the stand up pouch.

Various types of disposable, portable containers are known for storing a fluid or dry product. Typically, the flexible pouch is made from a flexible material where an outer layer of the material can have a pre-printed message to provide information to the consumer. The material used to form the flexible pouch is typically supplied in sheet form, on a roll, such that a plurality of pouches can be fabricated utilizing a manufacturing machine.

The pouch is generally formed utilizing a pouch forming machine that receives the rolls of flexible material and creates the flexible pouch. The pouch may include a gusset positioned between the parallel side edges of the pouch such that the pouch is able to stand unsupported. In some packaging configurations, an opening device, such as a fitment or spout, is sealed between the edges of the material at the upper edge of the pouch. The fitment allows material to be dispensed from the pouch while allowing the pouch to be re-sealed after a portion of the product has been removed.

While flexible pouches with fitments are desirable in many instances, they are difficult and costly to produce since each fitment must be individually inserted into the pouch and sealed. Furthermore, for effective sealing of the pouch walls to the fitment, commonly called caulking, a sealant layer is used between the fitment and the material used to form the front and back panels of the pouch. The sealant layer must be thicker and wider than what the other sealed seams of the pouch generally require. In present practice, this increase in sealant thickness at the fitment is accomplished by increasing the sealant thickness on the entire pouch structure. Therefore, there is a need for an improved machine that produces a flexible pouch with a fitment along with an improved method of making such a flexible pouch.

SUMMARY

The present disclosure generally relates to stand up pouches that are formed to receive and retain a product. Stand up pouches, such as in accordance with the present disclosure, are produced with a spout or fitment that allows product to be dispensed from the package. In accordance with the present disclosure, a sealant strip is applied to both the front and back panels of the package only in the area where the fitment canoe requires the increase in sealant material thickness. The narrow strips of sealant are inserted using a pouching line. The layer of sealant material is folded and slit to create the pair of sealant strips. The sealant material is heat-sealed to the front and back panels of the pouch before the fitment is installed. A narrow metal cooling plate is used during insertion of the sealant material to prevent the front and back panels of the pouch from sealing to themselves. After the fitment is positioned, the sealant material is used to create a fluid tight seal between the fitment canoe and the webs of material.

Various other features, objects and advantages of the invention will be made apparent from the following description taken together with the drawings.

BRIEF DESCRIPTION OF THE DRAWINGS

The drawings illustrate the best mode presently contemplated of carrying out the disclosure. In the drawings.

DETAILED DESCRIPTION

Figure 1:
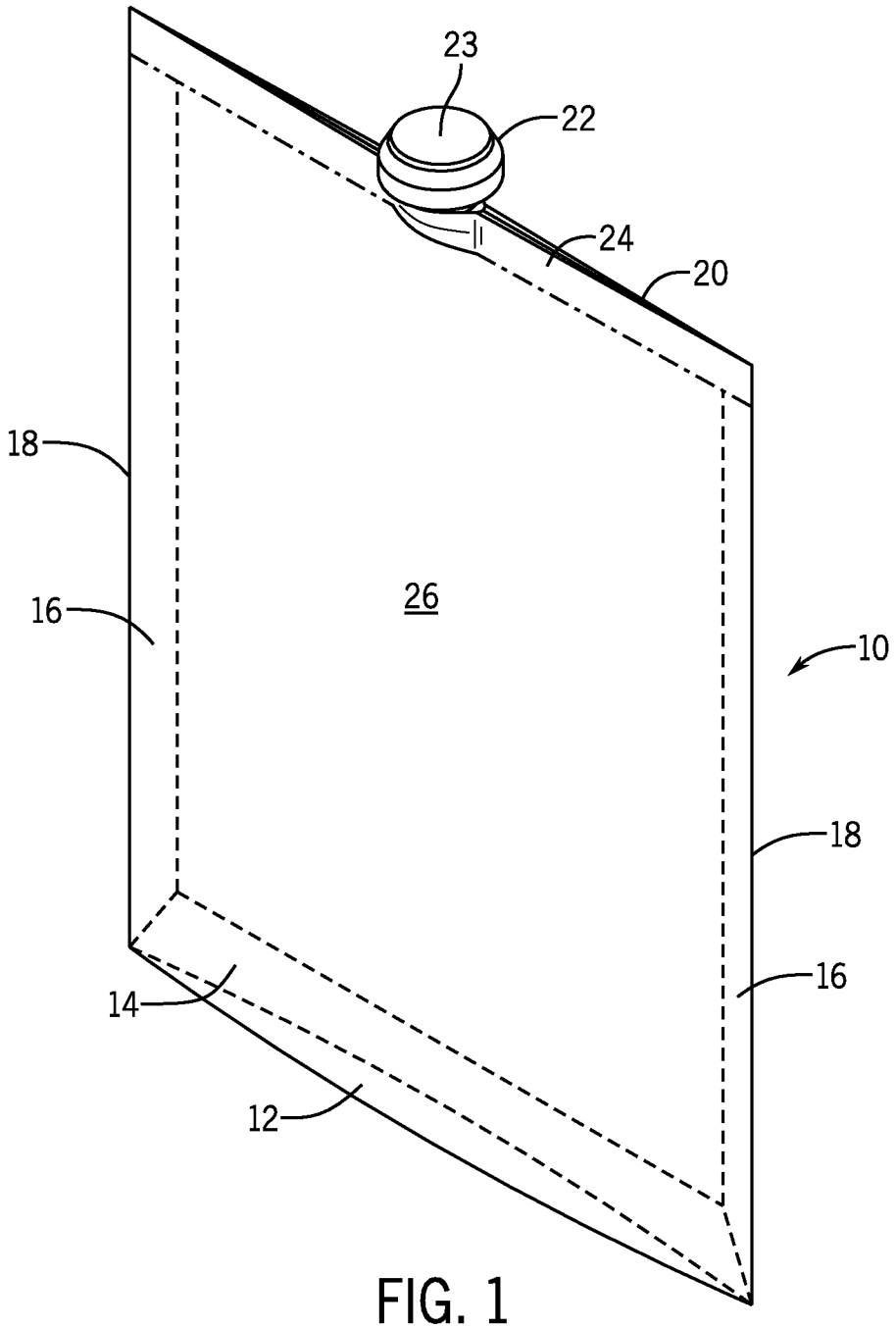
FIG. 1 is a perspective view of a stand up, flexible pouch constructed in accordance with the present disclosure.

FIG. 1 illustrates a flexible pouch 10 constructed in accordance with an exemplary embodiment of the present disclosure. The flexible pouch 10 shown in FIG. 1 is designed to be a stand up pouch that includes a gusset 12 formed at the bottom end 14 of the flexible pouch 10. The gusset 12 allows the flexible pouch 10 to stand on its own in the orientation shown in FIG. 1. Although a gusseted pouch 10 is shown in the embodiment of FIG. 1, it should be understood that the subject matter of the present disclosure would be equally applicable to a flexible pouch that does not include the gusset 12.

The flexible pouch 10 is preferably formed from a flexible, preprinted laminate material. The choice of the type of laminate material used to form the flexible pouch is non-limiting and is often dictated by the type of product contained within the open interior of the flexible pouch, the shape of the pouch or the anticipated use of the pouch. The thickness of the material used to form the flexible pouch 10 can also vary depending upon the desired use of the flexible pouch.

Figure 2:
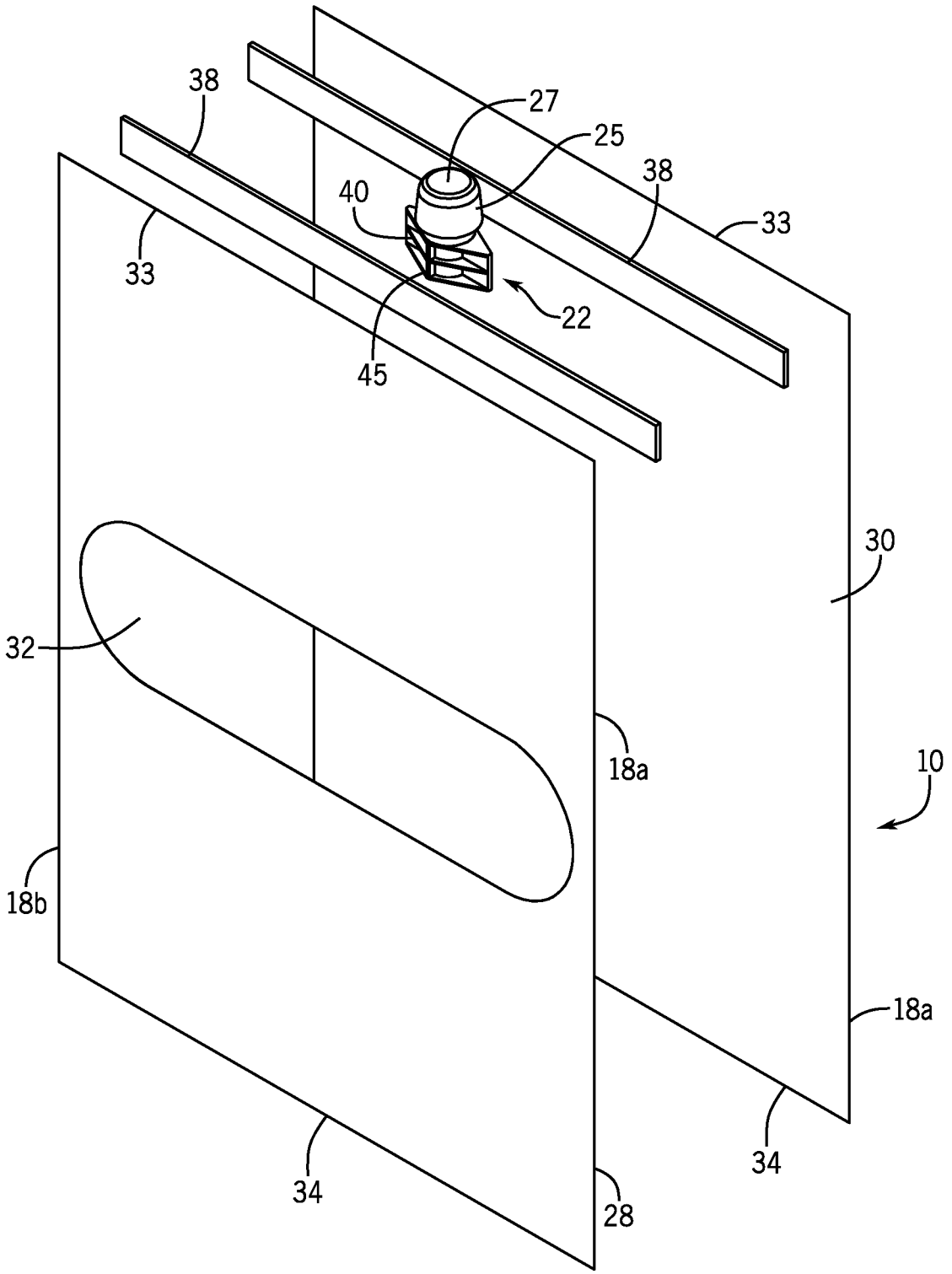
FIG. 2 is an exploded view of the components that form the flexible pouch of the present disclosure.
Figure 3:
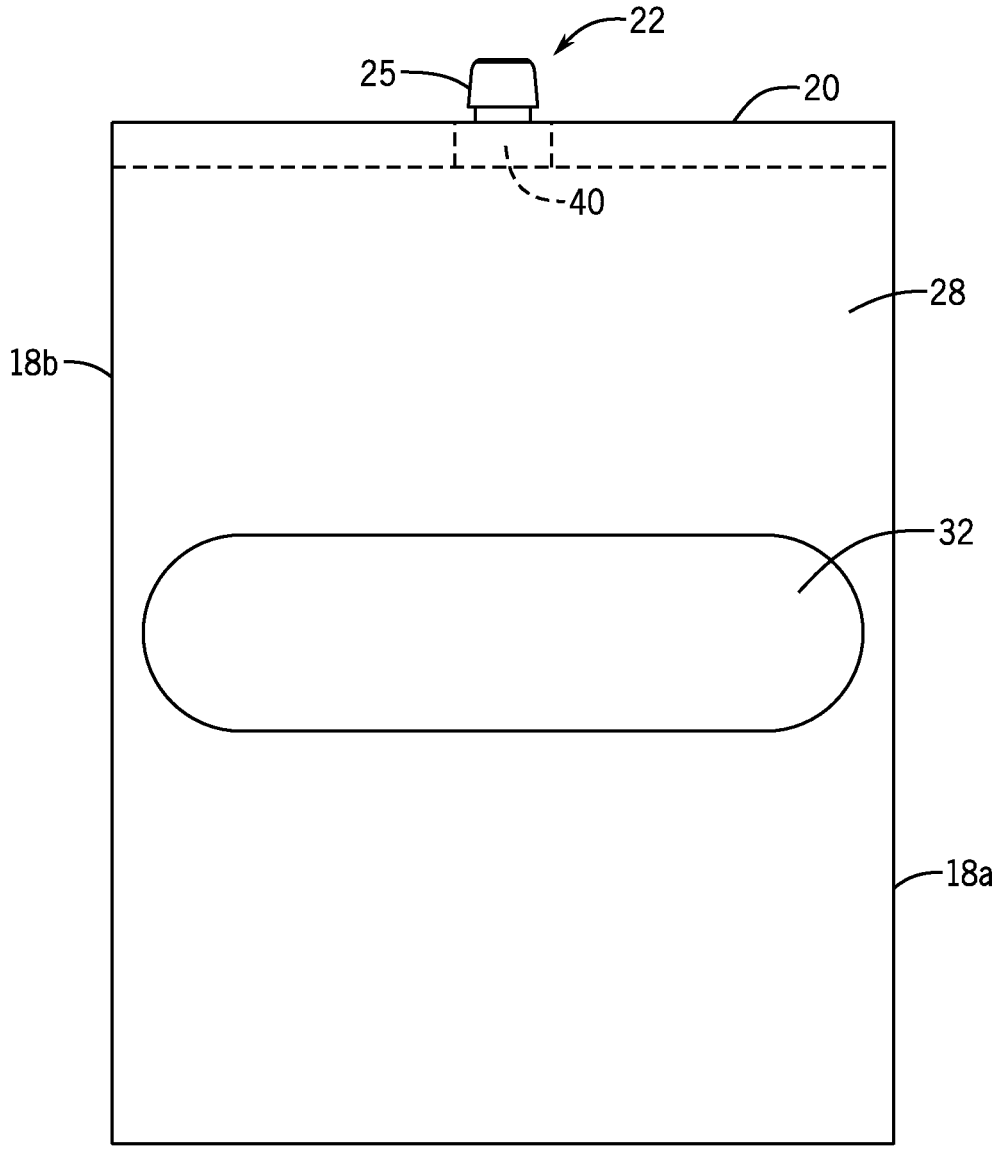
FIG. 3 is a front view of the flexible pouch.

As illustrated in FIGS. 1 and 2, the flexible pouch 10 includes a pair of side seals 16 that are typically heat seals used to join a front panel 28 and a back panel 30 at each of the two sides 18 of the flexible pouch. The top end 20 of the flexible pouch includes the fitment 22 which extends through the top seal 24 and provides access to the open interior 26 of the flexible pouch 10. The fitment 22 allows material to be selectively dispensed from the open interior 26 when the fitment is in an open condition. In the embodiment shown in FIG. 1, the fitment 22 includes a cover member 23 that is received on an externally threaded spout 25 that defines a discharge opening 27. The spout 25 is integrally formed with a lower attachment canoe 40. The spout 25 and the canoe 40 are integrally formed from a plastic material in the embodiment shown. The cover member 23 of the fitment 22 can be moved to a closed condition in which the cover member 23 prevents material from exiting the open interior 26. When the cover member 23 is removed, the material within the pouch can be dispensed through the opening 27 of the spout 25. In the embodiment shown in FIG. 1, the fitment 22 has a specific configuration with a removable cover member although other configurations are contemplated as being within the scope of the present disclosure.

Figure 4:
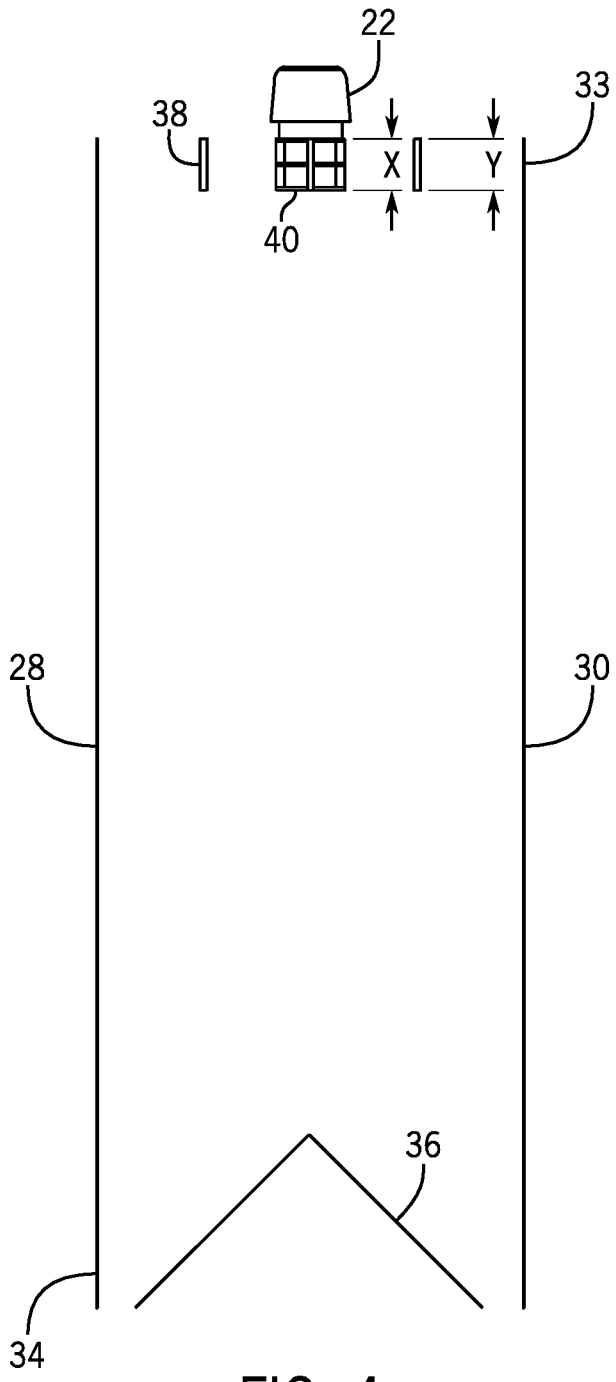
FIG. 4 is a section view of the flexible pouch in an exploded condition.

Referring now to FIGS. 2-5, the specific components used to form the flexible pouch 10 are shown in greater detail. The flexible pouch 10 is formed from a front panel 28 and a back panel 30 of flexible material that each cut from the same or separate webs of the same material. As discussed above, the material used to form the front and back panels and the thickness of the material can be selected depending on the size, intended use and the product contained within the interior of the pouch. In the embodiment shown in FIG. 2, the front panel 28 includes a transparent window 32, although this transparent window 32 could be eliminated. Both the front panel 28 and the back panel 30 are cut from webs of material, as will be discussed in greater detail below. After being cut from the web of material, each of the front and back panels 28, 30 includes a first side edge 18*a* and a second side edge 18*b*. Each panel of material includes a top edge 33 and a bottom edge 34. The bottom edges 34 of the two panels can be joined to a gusset material 36, which is best shown in FIG. 4. The gusset material 36 is a folded portion of typically the same material used to create the front and back panels 28, 30. The gusset 36 allows the pouch to stand after being formed and filled with the material to be dispensed.

Figure 5:
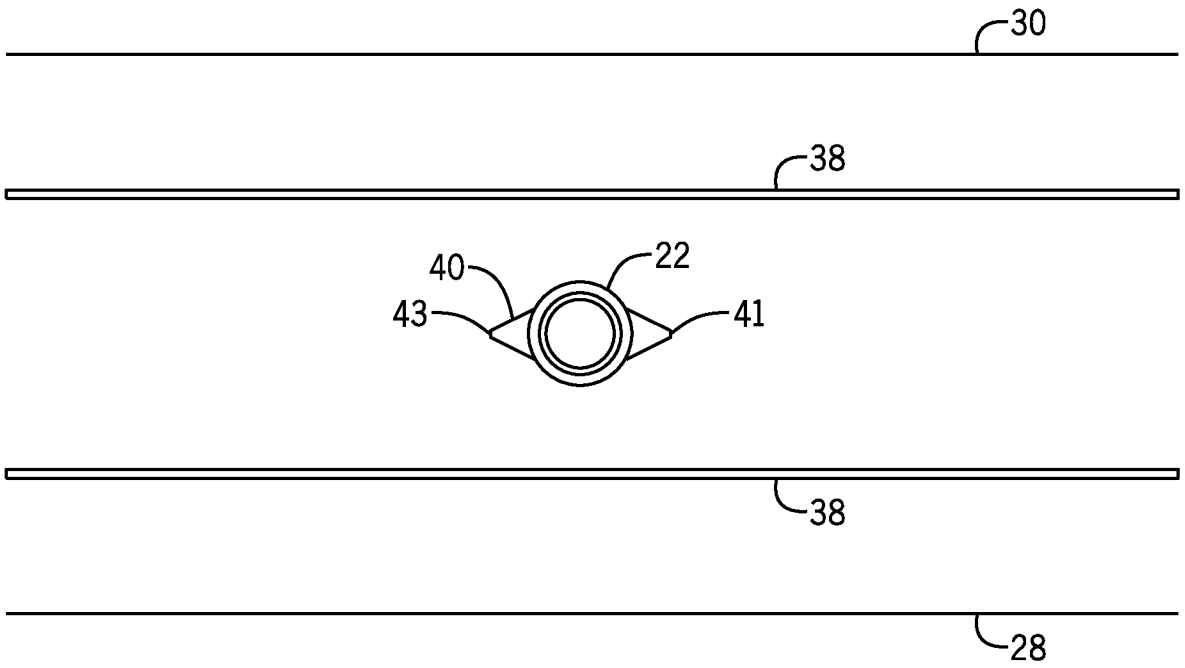
FIG. 5 is a top view of the flexible pouch in an exploded condition.

As best illustrated in FIGS. 2 and 5, the fitment 22 includes the canoe 40. The canoe 40 extends from a first end 41 to a second end 43 and tapers from a center area 45 to the respective first and second ends 41 and 43. The canoe 40 has a height X that is shown in FIG. 4. When the fitment 22 is installed in the pouch 10, the entire height X of the canoe 40 is below the top end 20 such that only the spout 25 extends above the top end 20.

Referring now to FIG. 2, a sealant strip 38 is provided on each side of the fitment 22 to seal the fitment 22 between the front panel 28 and the back panel 30. As discussed above and shown best in FIG. 4, the canoe 40 has a height X. In an exemplary embodiment of the present disclosure, each of the sealant strips 38 has a width Y that very closely corresponds to the height X of the canoe 40. In the exemplary embodiment of the present disclosure, the width of the sealant strip Y is slightly greater than the height of the canoe X to ensure that the pair of sealant strips 38 creates the required seal between the canoe 40 of the fitment 22 and the front panel 28 and the back panel 30.

The method of forming the stand up, flexible pouch 10 shown in FIG. 1 in accordance with an exemplary embodiment of the present disclosure is best described with reference to the schematic sequence of diagrams shown in FIGS. 6-12.

Figure 7:
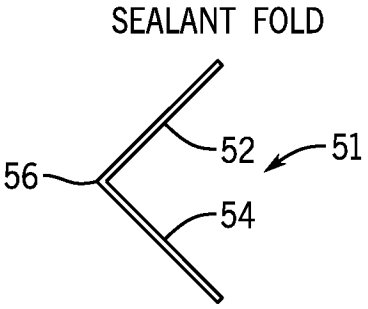
FIG. 7 illustrates the formation of first and second legs of the sealant material.
Figure 6:
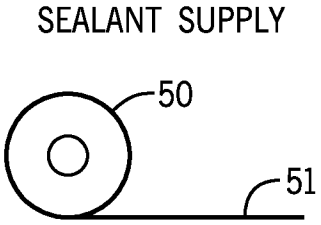
FIG. 6 is a schematic view of the first step in the method of manufacturing which includes providing a roll of sealant material.

As shown in FIG. 6, a roll 50 of sealant material 51 is supplied that will be used to form the sealant strip 38 on each side of the canoe 40 of the fitment 22. The roll of material 50 is unwound and the sealant material 51 is folded along a fold line 55, as shown in FIG. 7, to create the first leg 52 and the second leg 54. It is contemplated that the same type of equipment used to form the gusset at the bottom of the flexible pouch could be used to create the folded portion of sealant material 51 shown in FIG. 7.

Figure 8:
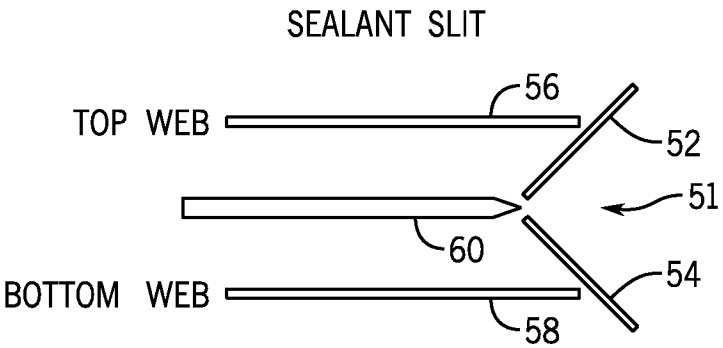
FIG. 8 illustrates the position of the sealant material between top and bottom webs and the separation of the first and second legs of the sealant material.

Once the sealant material 51 is folded to create the first and second legs 52, 54, the folded section of sealant material is inserted between the top web 56 and the bottom web 58 as shown in FIG. 8. The top web 56 and bottom web 58 are formed from the material that form the front panel 28 and back panel 30 of the stand up pouch as was previously described.

Once the top and bottom webs 56, 58 and the folded sealant material 51 are in position as shown in FIG. 8, a cutting tool 60 is moved between the top and bottom webs. The cutting tool is then used to separate the first leg 52 from the second leg 54, as shown in FIG. 8.

Figure 9:
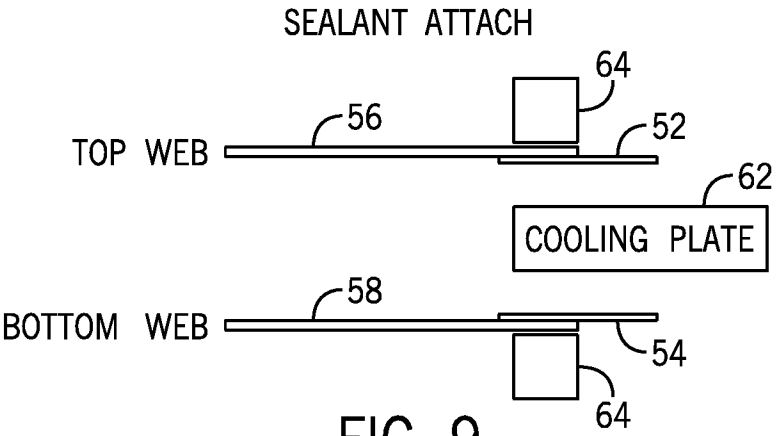
FIG. 9 illustrates the attachment of the sealant material to the top and bottom webs while a cooling plate is positioned therebetween.

After the first leg 52 has been separated from the second leg 54, a narrow metal cooling plate 62 is inserted between the top web 56 and the bottom web 58 as shown in FIG. 9. Once the cooling plate 62 is positioned, heat bars 64 are brought into contact with the outer surfaces of the top and bottom webs 56, 58 to heat seal the sealant legs 52 and 54 to the top and bottom webs without creating a heat seal between the legs 52 and 54.

Figures 10, 11, 12:
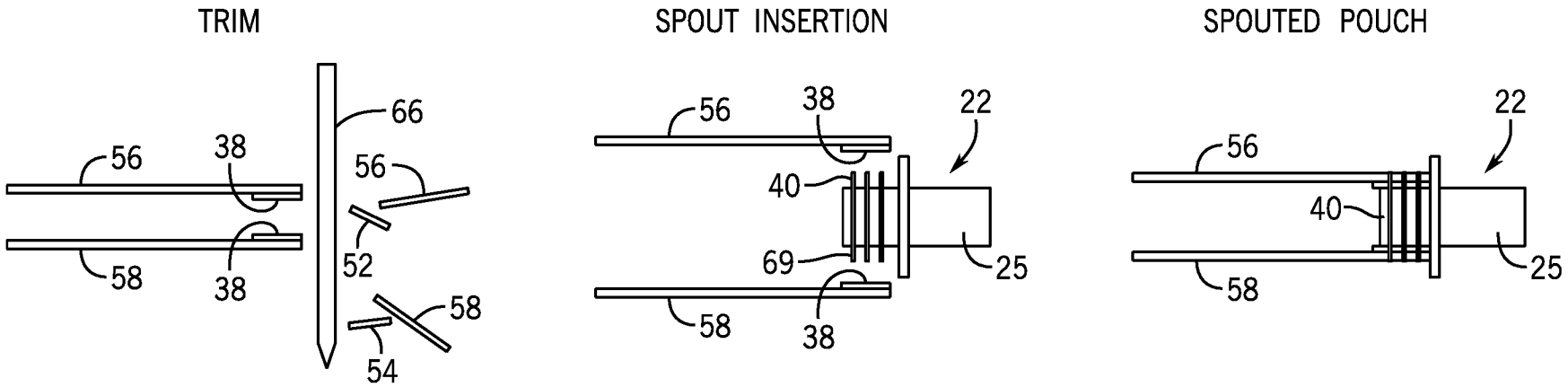
FIG. 10 illustrates the step of trimming the first and second sealant strips to a desired width.
FIG. 11 illustrates the insertion of the canoe of the fitment between the first and second sealant strips.
FIG. 12 illustrates the sealing attachment between the fitment and the top and bottom webs of the pouch.

Once the legs 52 and 54 of the sealant material are heat-sealed to the top web 56 and the bottom web 58, a trimming blade 66 is used to trim excess portions of both the top and bottom webs as well as the first and second legs of the sealant material, as shown in FIG. 10. After the trimming step shown in FIG. 10, the width of each of the sealant strips 38 will be the width Y shown in FIG. 4.

After the trimming process shown in FIG. 10, the sealant strips 38 securely attached to the top and bottom webs 56, 58 have the desired width. The fitment 22 is brought into position such that the canoe 40 of the fitment 22 is aligned with the sealant strips 38. In the exemplary embodiment shown in FIG. 11, the canoe 40 includes a series of ribs 69 that aid in the sealing process between the sealant strips 38 and the canoe 40. As shown in FIG. 11, the height of the canoe 40 generally corresponds to the width of the sealant strips 38 when the canoe is aligned with the strips of sealant. When in this position, the spout 25 is positioned outside of the layers of material.

After the fitment 22 is positioned as shown in FIG. 11, the sealant material that forms the two sealant strips 38 is heat-sealed into contact with the ribs 69 of the canoe 40 to create a seal between the canoe 40 and the top web 56 and the bottom web 58. After the step shown in FIG. 12, the top web 56 and the bottom web 58 are heat-sealed to each other along the side edges and a section of gusset material is heat-sealed between the top web 56 and the bottom web 58 to create the stand up pouch previously described.

In accordance with the process and system of the present disclosure, the thickness of the sealant material can be decreased as compared to prior designs since the sealant material is installed at the specific and precise location that is aligned with the canoe 40 of the fitment 22. Although in the embodiments shown in the drawing figures, the layer of sealant extends across the entire width of the stand up pouch, it is contemplated that the length of the sealant material could be decreased such that the sealant material would only cover the canoe 40 and a small area of the flexible material on either side of the canoe.

Figure 13:
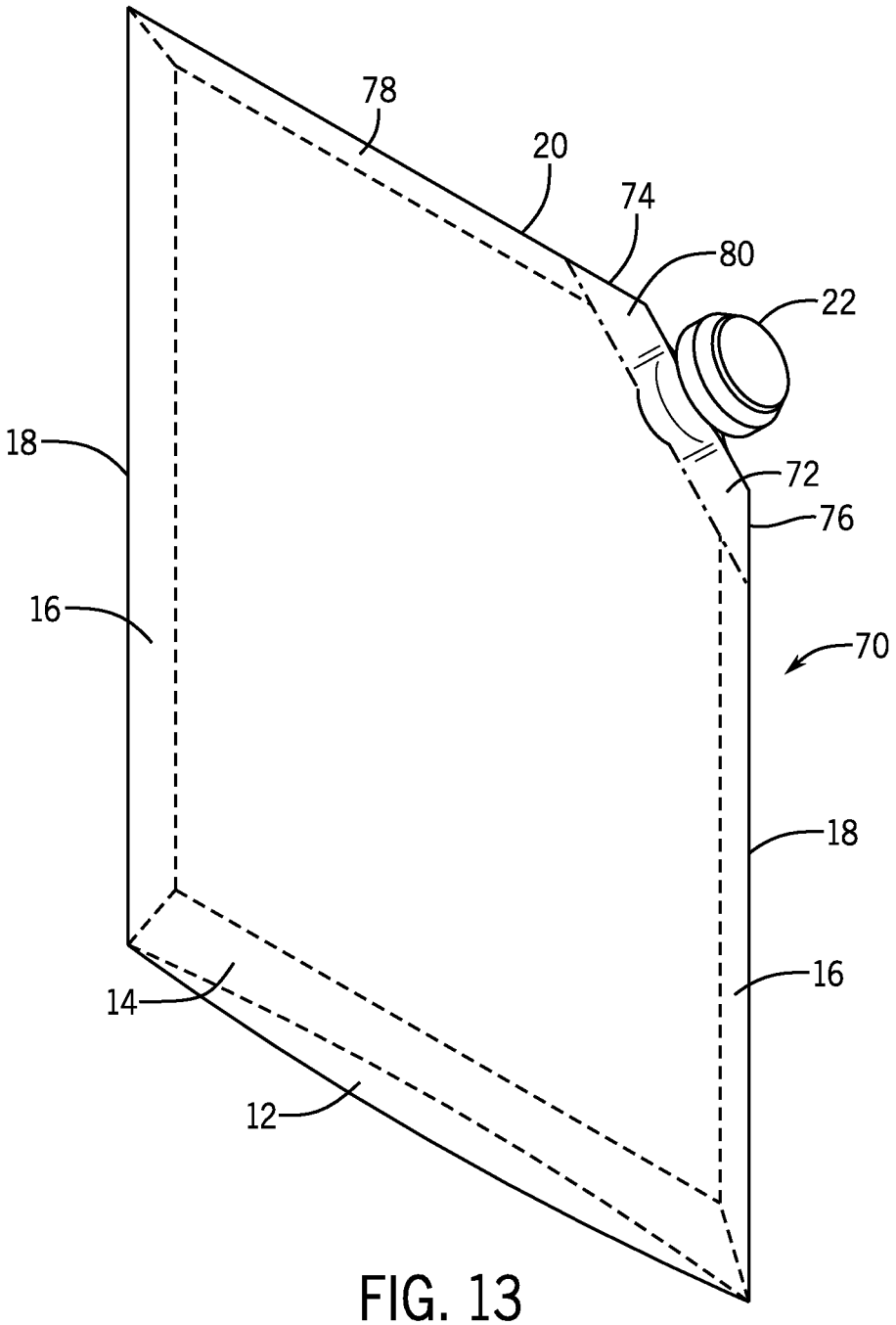
FIG. 13 is a perspective view of a second embodiment of a stand up, flexible pouch constructed in accordance with a second embodiment of the present disclosure.

FIG. 13 illustrates another type of flexible pouch 70 constructed in accordance with the present disclosure. The flexible pouch 70 includes many of the same features as describe previously and similar reference numbers are used to facilitate understanding. In the embodiment shown in FIG. 13, the fitment 22 is positioned along a corner 72 of the pouch rather than along the top end 20. In this embodiment, a sealant strip is attached to each of the front and back panels and extends from the sealing area 74 along the top end 20 to the sealing area 76 along the side edge 18. As in the embodiment discussed above, the width of the sealant strips is slightly larger than the height of the canoe formed as part of the fitment 22. In the embodiment shown in FIG. 13, a top heat seal 78 is formed at the top end 20 across the width of the pouch 70 other than in the fitment sealing area 80.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

We claim:

1. A method of forming a flexible pouch configured to receive a liquid product, comprising the steps of:

providing a top web and a bottom web of material spaced from each other;

providing a web of sealant material;

folding the web of sealant material to create a first sealant strip and a second sealant strip joined to each other at a fold line;

positioning the folded web of sealant material such that the first sealant strip is in contact with the top web and the second sealant strip is in contact with the bottom web;

separating the first sealant strip from the second sealant strip;

attaching the first sealant strip to the top web and the second sealant strip to the bottom web;

inserting a fitment between the first sealant strip and the second sealant strip; and sealing the fitment to the first and second sealant strip and between the top web to the bottom web to form a top end of the flexible pouch;

further comprising a step of trimming a portion of the first sealant strip and the second sealant strip when the first and second sealant strips are attached to the top web and the bottom web to define the width of the sealant strips.

2. The method of claim 1 wherein the fitment includes a canoe and a spout, wherein the canoe is sealed to the first and second sealant strips.

3. The method of claim 2 wherein a height of the canoe and a width of the first and second sealant strips are the same.

4. The method of claim 1 wherein a height of the fitment within the flexible pouch is the same as the width of the first and second sealant strips.

5. The method of claim 1 wherein the first sealant strip is separated from the second sealant strip along the fold line.

6. The method of claim 1 further comprising the steps of:

positioning a cooling plate between the first and second sealant strips;

applying heat to the top web to seal the first sealant strip to the top web; and applying heat to the bottom web to seal the second sealant strip to the bottom web.

7. The method of claim 6 wherein the heat is applied to the top and bottom webs while the cooling plate is between the first and second sealant strips.

8. A method of forming a flexible pouch configured to receive a liquid product, comprising the steps of:

providing a top web and a bottom web of material spaced from each other;

positioning a first sealant strip in contact with the top web and a second sealant strip in contact with the bottom web;

positioning a cooling plate between the first and second sealant strips;

applying heat to the top web to attach the first sealant strip to the top web;

applying heat to the bottom web to attach the second sealant strip to the bottom web;

inserting a fitment between the first sealant strip and the second sealant strip; and sealing the fitment to the first and second sealant strip and the top web to the bottom web to form a top end of the flexible pouch;

further comprising the step of trimming a portion of the first sealant strip and the second sealant strip after the first and second sealant strips are attached to the top web and the bottom web to define a width of the sealant strips.

9. The method of claim 8 wherein the fitment includes a canoe and a spout, wherein the canoe is sealed to the first and second sealant strips.

10. The method of claim 9 wherein a height of the canoe and a width of the first and second sealant strips are the same.

11. The method of claim 8 wherein a height of the fitment within the flexible pouch is the same as the width of the first and second sealant strips are the same.

12. The method of claim 8 wherein the heat is applied to the top and bottom webs while the cooling plate is between the first and second sealant strips.

* * * * *